US005211674A

United States Patent [19]

Cooper, III et al.

[11] Patent Number: 5,211,674

[45] Date of Patent: May 18, 1993

[54] METHOD AND APPARATUS FOR PACKAGING TAPE ROLLS

[75] Inventors: Clayton C. Cooper, III, Waterford; David R. Gordon, Schenectady; William B. Drobish, Amsterdam, all of N.Y.

[73] Assignee: Phoenix Enterprise Associates, Ltd., Albany, N.Y.

[21] Appl. No.: 850,347

[22] Filed: Mar. 11, 1992

[51] Int. Cl.[5] ..... B65B 25/24; B65B 35/52

[52] U.S. Cl. ..... 53/541; 53/204; 53/254; 53/532

[58] Field of Search ..... 53/447, 541, 532, 254, 53/409, 204

[56] References Cited

U.S. PATENT DOCUMENTS

| | | | |
|---|---|---|---|
| 2,556,214 | 6/1951 | Pottle | 53/254 X |
| 2,875,909 | 3/1959 | Babick et al. | 53/204 X |
| 3,737,028 | 6/1973 | Carlson | 53/409 X |
| 3,946,884 | 3/1976 | Kato et al. | 53/540 X |
| 4,875,326 | 10/1989 | Piano | 53/541 X |
| 4,942,718 | 7/1990 | Courtois et al. | 53/254 X |

*Primary Examiner*—James F. Coan

[57] ABSTRACT

An apparatus and method for packaging a plurality of tape rolls of uniform diameter, each having a central core of uniform diameter a plurality of which are carried by a mandrel. The apparatus and method provides means for removing the aforesaid mandrel and for transferring the tape rolls thereafter to a conveyor which moves each roll seriatim into a magazine for stacking therein. The stacking apparatus provides means for lifting each tape in the magazine one tape width and for supporting and maintaining the lifted tape until the next tape conveyed into the magazine has also been lifted and supported and so on to create a prescribed stack. Thereafter the stack, or plurality of stacks created in the magazine can be lifted upon mandrels inserted into the core diameters of each stack, moved and inserted into cartons for shipment.

6 Claims, 6 Drawing Sheets

METHOD AND APPARATUS FOR PACKAGING TAPE ROLLS

BACKGROUND OF THE INVENTION

The present invention has its application in the field of packaging various products whose shape and conformity lend themselves to being stacked and after stacking, being loaded into containers for shipping. More specifically, the particular embodiment disclosed herein concerns application of the inventive concept to packaging tapes. Existing patent literature reveals that numerous attempts to automate packaging of various products have been proposed; however examination of these in comparison with the present invention will clearly show why the former has failed and the latter has succeeded.

To illustrate, the stacking method disclosed in U.S. Pat. No. 3,526,075 fails to provide means to support and maintain successive layers of a stack in a positive and foolproof manner, as does the apparatus of the present invention. Without such support, the disolution of the stack is inevitable. Simular deficiencies can be observed in the proposed mechanisms shown in U.S. Pat. Nos. 4,983,097 and 4,865,515. The fact remains that while manufacturing processes which precede the packaging of many products have been automated, package automation has typically eluded practical solution. Such has been the experience with tape roll packaging which is done manually at great expense.

SUMMARY OF THE INVENTION

In accordance with the present invention, there has been devised a unique, rapid and foolproof method and apparatus for stacking products prior to packaging and shipment. The stacking method and apparatus is broadly applicable to any product having two parallel flat surfaces which can form lower and upper surfaces respectively to form a vertical stack. In the presently disclosed application, cylindrical tape rolls having the same outer diameter are wound around open cores which have the same diameter. To form a single stack (in practice four parallel stacks of tapes shall be formed simultaneously with a magazine) tapes shall be conveyed one flat side down, one after the other into the magazine to form a single layer therein. Next, the tape(s) are lifted slightly more than one tape width by a lifter which bears against the lower surface of the tape(s). A shelf arranged to reciprocate laterally into and from the interior of the magazine shall then underride the adjacent edge of the tape which has just been lifted, such shelf also having means to engage the vertical side of the tape so that further lateral movement of the shelf shall move the tape laterally where the opposite side of the tape may then rest upon a horizontal abutment. The tape shall then be maintained momentarily in such raised position upon the shelf and such abutment. The lifting means is then retracted and the next layer of tape(s) loaded beneath the raised tape(s). This process is repeated to form a stack or parallel stacks within the magazine. In practice, the magazine shall accommodate four stacks, two each loaded simultaneously from opposite sides of the magazine. The magazine shall include a central vertical divider and an abutment for supporting one side of two tapes shall be located along the base of the divider on opposite sides thereof.

The invention further includes unique conveying means, means for discharging tapes thereon after separating tape rolls from mandrels upon which they are received from manufacturing, and means for distributing tapes into two parallel paths for quick loading into the magazine.

DESCRIPTION OF A PARTICULAR EMBODIMENT

Figure 1:
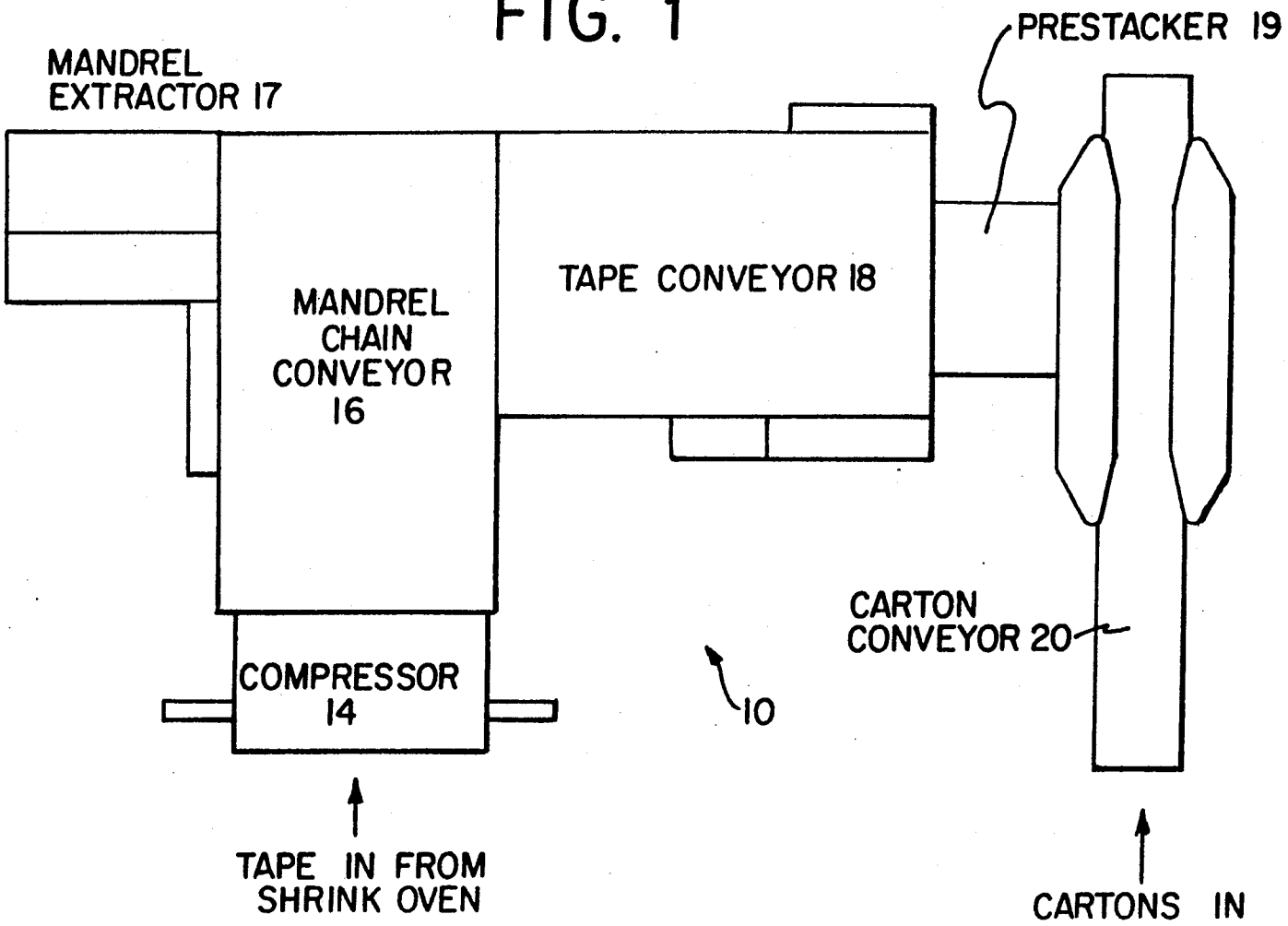
FIG. 1 illustrates schematically the respective sections and their physical relationship to each other which comprise the machine incorporating the present invention.
Figure 1A:
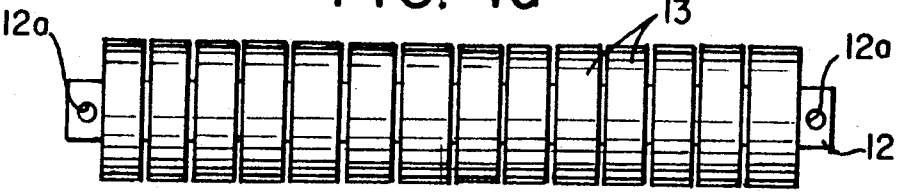
FIG. 1*a* illustrates a typical tape and mandrel assembly which the machine of the present invention shall process in order to load the tapes into cartons.

Referring now to the drawing, FIG. 1 illustrates schematically tape packaging machine 10 constructed according to the principles of the present invention. The machine 10 includes a compressor 11 which is adapted to receive the mandrel 12 and plurality of tapes 13 arranged thereon or variants thereof as has been shown in FIG. 1*a*. The mandrel 12 and tape 13 assembly as noted in FIG. 1 are received seriatim from a shrink oven which is the final phase of tape manufacture. It will be noted that as shown in FIG. 1*a*, the tapes 13 are spaced apart on mandrel 12 in order to permit each tape to be shrink-wrapped in the oven as a final individual packaging step in tape manufacture.

The first step in the process of preparing the tapes 13 for packaging requires removal of tapes 13 from mandrel 12. It will be noted that as received from the shrink oven and as depicted in FIG. 1*a*, very little of mandrel 12 protrudes from the array of tapes 13 thereon and since it shall be necessary to grasp the ends of the mandrel 12 in order to convey it and subsequently to extract the mandrel, it is necessary to compress or move the tapes from each end of the mandrel toward its center. Accordingly a compressor 14 (which together with the other sections shown in FIG. 1 shall be described in detail) shall initially cause such tape movement upon the mandrel 12. After compression or movement of the tapes 13 toward the center of each mandrel 12, the respective mandrels are conveyed by the mandrel chain conveyor 16 to the mandrel extractor 17. As will be described, immediately subsequent to mandrel extractor 17. As will be described, immediately subsequent to mandrel extraction, tapes 13 shall be received upon a secondary mandrel whose function is to deposit tapes upon tape conveyor 18. The tape conveyor shall feed tapes in orderly succession to the prestacker section 19 which stacks groupings of tapes immediately prior to transport into cartons on the carton conveyor 20.

Figure 2:
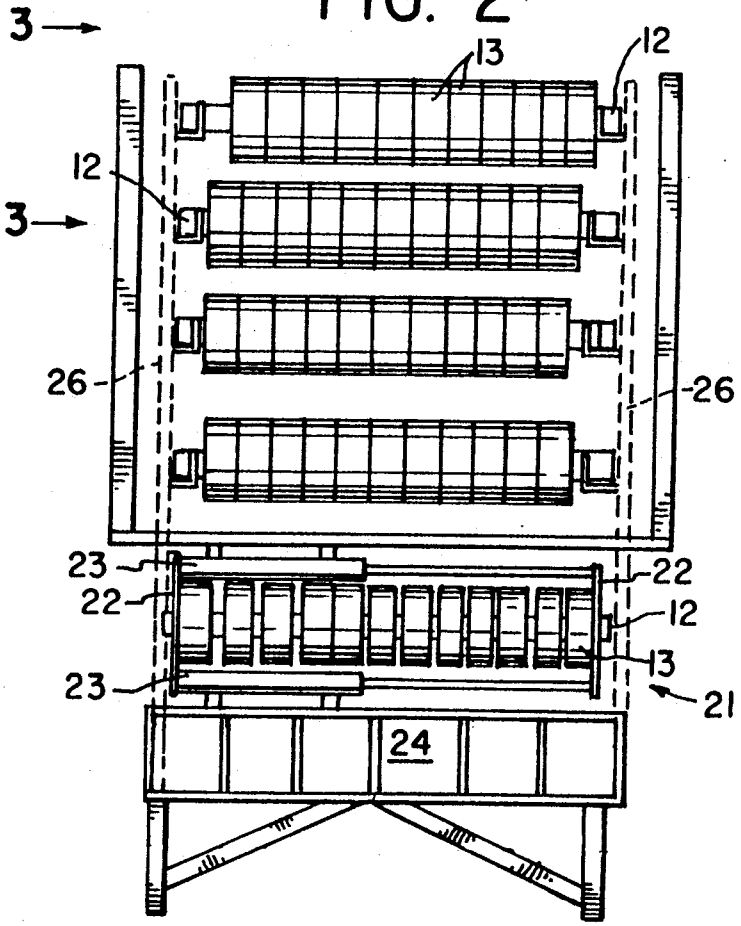
FIG. 2 illustrates the compressor and mandrel chain conveyor sections of the machine of FIG. 1.
Figure 3:
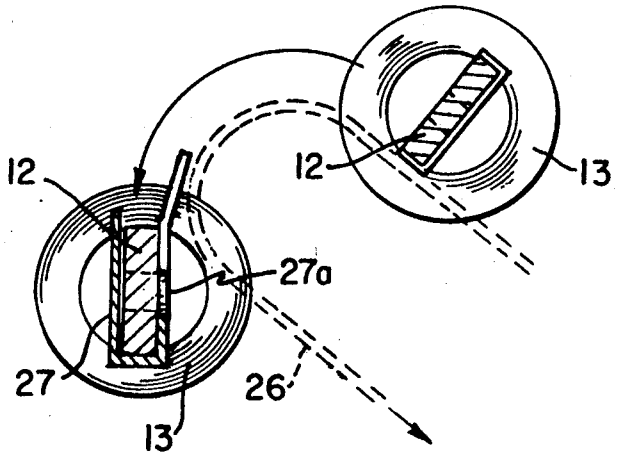
FIG. 3 is a view taken in the direction of arrows 3—3 of FIG. 2 which illustrates a portion of the mandrel extractor mechanism.

Having briefly described the arrangement and functions of the respective sections of the tape packaging machine 10, we shall refer to FIG. 2 which illustrates the compressor section 14 and mandrel chain conveyor section 16. Mandrel 12 and tape 13 assemblies such as shown in FIG. 1 shall be delivered from the shrink oven one after the other at appropriate intervals to be received initially within a cradle 21. The cradle includes a generally U-shaped member at each end thereof (similar to that shown in FIG. 3) which shall effect vertical orientation of the mandrels 12 which are oblong in cross-section. Compressor 14 includes opposed platens 22 driven by piston actuators 23 toward the center of each mandrel 12 which shall move (compress) tapes toward the center of each mandrel to expose each end thereof sufficiently for subsequent mandrel conveyance and extraction. Initially for example as received from the shrink oven, mandrels 12 may project from the assemblage of tapes 13 thereon less than one inch. After compression, mandrel ends should project at each end about 3.5 inches.

After compression, a cradle 21 shall open to release mandrel and tape assemblies into a transport section 24. A chain conveyor 26 carrying U-shaped lugs will pick up the exposed ends of each mandrel 12 and carry successive compressed mandrels 12 and tapes 13 assembled thereon upwardly (about 30° incline) to the position of FIG. 3. As the chain conveyor 26 reverses direction, each mandrel shall be dropped into a receptacle 27 which maintains the aforesaid vertical orientation of the long dimension of each mandrel 12. Receptacle 27 has been provided with a rectangular slot **27*a* which is part of a latch mechanism (FIG. 4) to permit engagement between a mandrel removal rod 28 having a pin 28*a* which is first aligned with circular aperture 12*a* in mandrel 12 within slot 27*a* of latch receptacle 27. Pin 28*a* shall be inserted in aperture 28*a* when such alignment between pin 28*a* and aperture 12*a*** is achieved.

Figures 4, 5, 6:
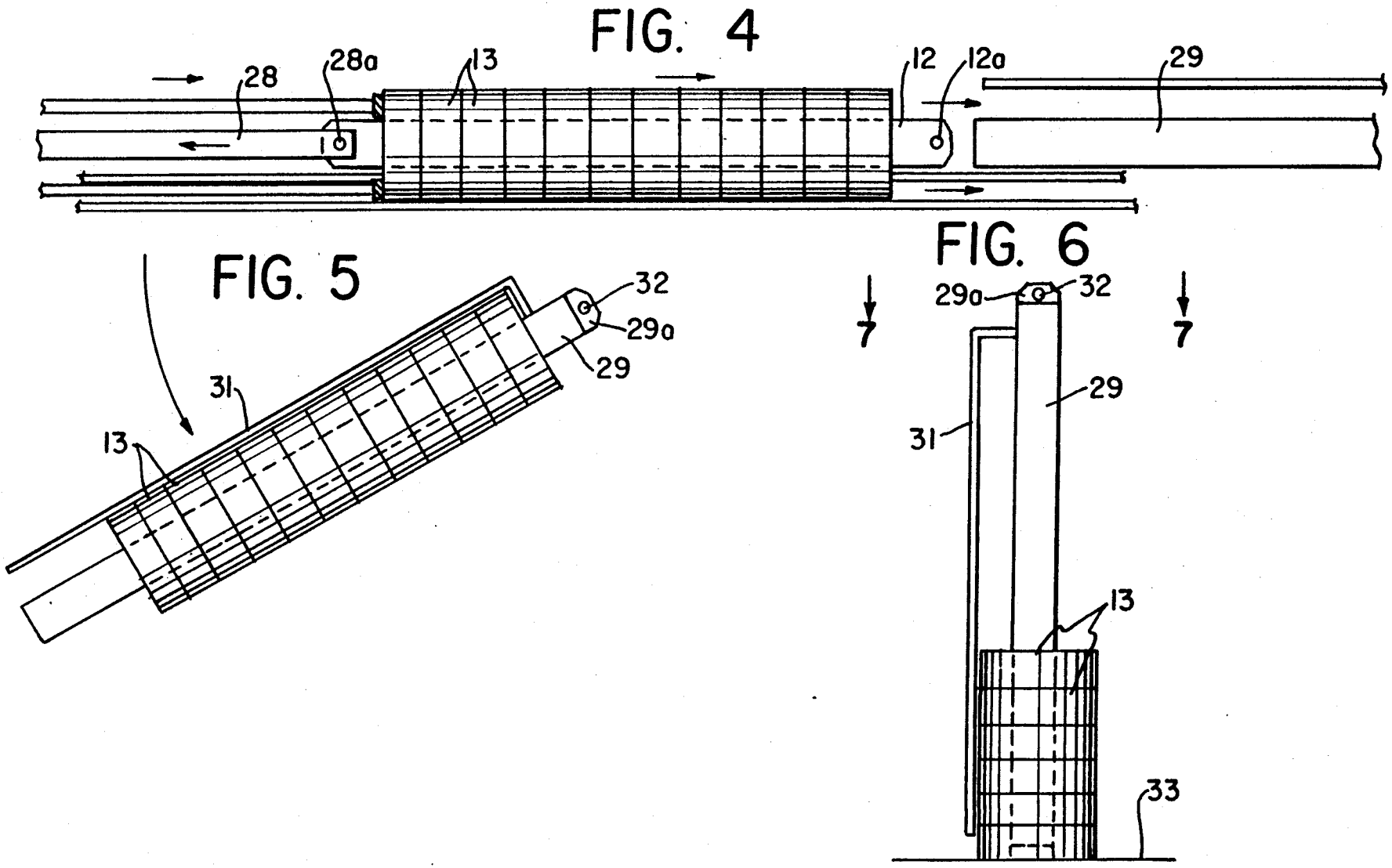
FIG. 4 further illustrates the primary mandrel extractor mechanism and the initiation of tape transfer onto a secondary mandrel.
FIGS. 5 and 6 illustrate the rotation of the secondary mandrel into a vertical position, carrying tapes after transfer thereto of tapes from the primary mandrel, and the beginning of release of the tapes upon a conveyor.

As seen in FIG. 4, a secondary mandrel 29 is positioned in alignment with primary mandrel 12. A piston-actuated stripper 30 shall be actuated by appropriate sensing means to strip the plurality of tapes 13 from mandrel 12, causing such tapes to be received by secondary mandrel 29 while rod 28 draws mandrel 12 from tapes 13. The construction of secondary mandrel 29 is better seen in FIGS. 5 and 6. The length of secondary mandrel 29 is somewhat greater than that of primary mandrel 12. Also, mandrel 29 is equipped along one side with a rod 31 which extends parallel to and lengthwise of mandrel 29 in order to circumferentially restrain movement of tapes from mandrel 29 against centrifugal force as it moves from the horizontal tape receiving position of FIG. 4 to its vertical tape discharging position of FIG. 6. Rotation of mandrel 29 is effected by rotary actuator 32 which is connected to flange **29*a*. FIG. 6 illustrates secondary mandrel 29 having rotated into its vertical tape discharge position with tapes 13 being deposited upon conveyor 33**.

Figure 7:
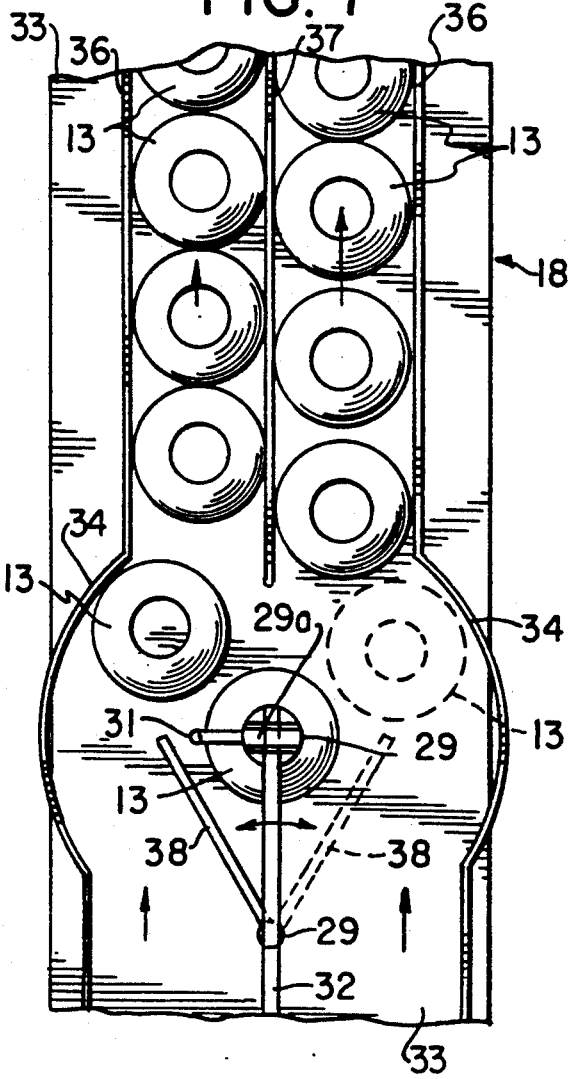
FIG. 7 illustrates the tape conveyor of the machine of the invention.

Referring to FIG. 7 it will be seen that tapes 13 shall be deposited centrally upon conveyor 33 in a discharging area defined by arcuate upright sides 34 which are each joined to straight sides 36. A central dividing member 37 intermediate sides 36 forms two passageways which are sufficiently wide to pass one tape after the other but no wider. As tapes 13 are successively deposited in the discharge area by secondary mandrel 29, a shuttle 38 which is reciprocated between the indicated solid and dotted-line positions by actuator 39 causes alternate distribution of tapes left and right of divider 37 and the conveyor 33 together with arcuate sides shall effect equal distribution of tapes 13 into the two respective passageways defined by each side member 36 and central divider 37. The speed of conveyor 33 shall be regulated so that, as illustrated, tapes 13 shall be caused to contact each other shortly after being directed into the two parallel illustrated paths, such speed of the conveyor being somewhat greater than the speed at which the pre-stacking section 19 receives and stacks tapes, the operation of which shall now be described.

Figure 8:
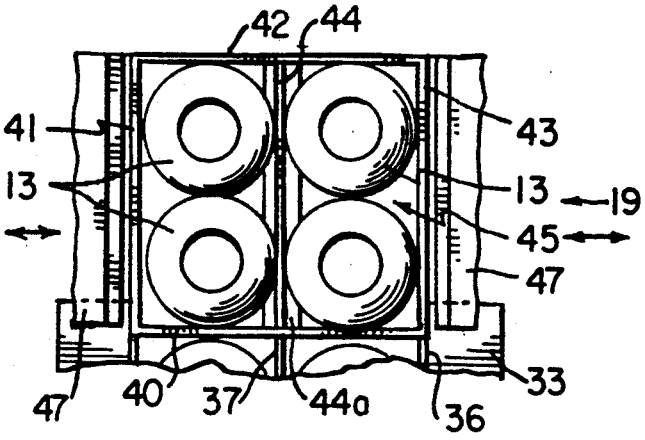
FIG. 8 illustrates the initiation of the pre-stacking phase of the present invention.
Figure 9:
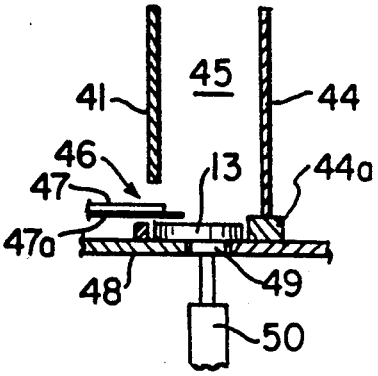
FIGS. 9 and 18 illustrate the pre-stacking of two layers of tapes into a magazine.

Referring to FIG. 8 it will be seen that the pre-stacking section 19 includes a rectangular magazine 45 having four connected peripheral walls 40–43 and a center partition 44 of a size and dimension to accommodate loading therein four tapes 13 horizontally positioned, and successive layers of four tapes each in a stack, for example, eight to ten tapes high. Side walls 41, 43 of the magazine define lengthwise horizontal openings 46 (see FIGS. 9–18) which permit intermittent entry into the magazine of shelf members 47. Shelf members 47 cooperate with a fixed lengthwise abutment **44*a* extending along the base of center partition 44 in the stacking process. Magazine 45 further includes a base 48 having two lengthwise (i.e., the direction of tape travel) openings 48*a* therein each of which admits lifters 49 (one lifter each for two tapes) which operate in sequence with shelf members 47 to stack successive layers of tape (four tapes each) in the magazine 45. It shall be understood that shelf members 47 and lifters 49** shall each be movable by suitable actuating means responsive to sensors controlling the orderly sequential operation of tape stacking which shall be described, such mechanisms being well known for the purposes of such movements.

Figure 10:
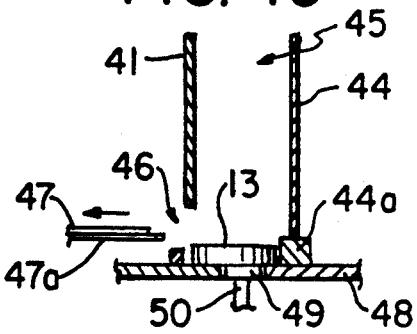
Figure 11:
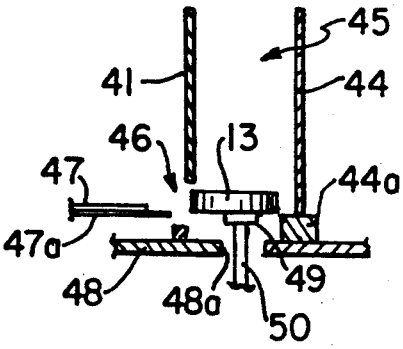
Figure 12:
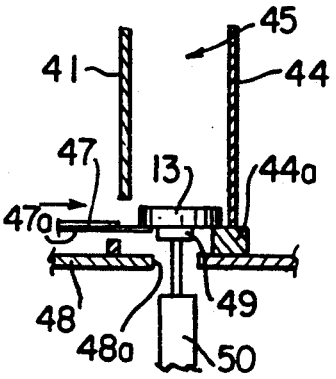
Figure 13:
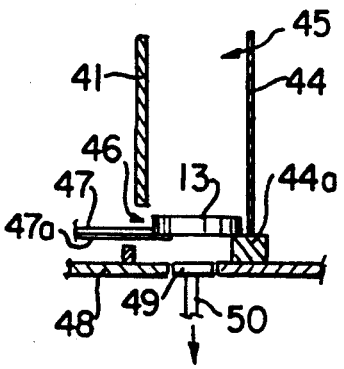
Figure 14:
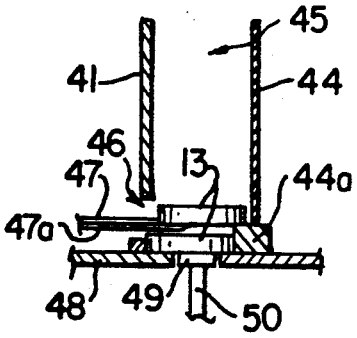
Figure 15:
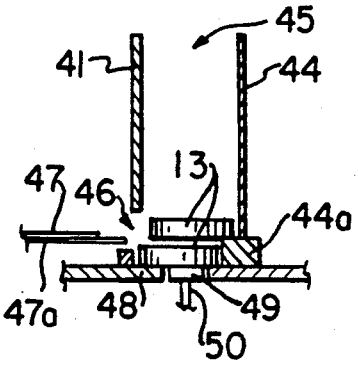
Figure 16:
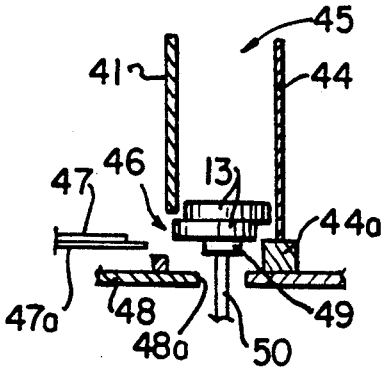
Figure 17:
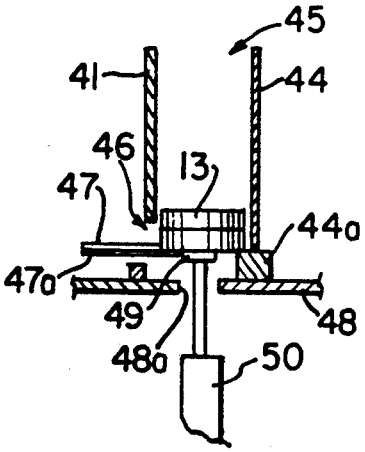
Figure 18:
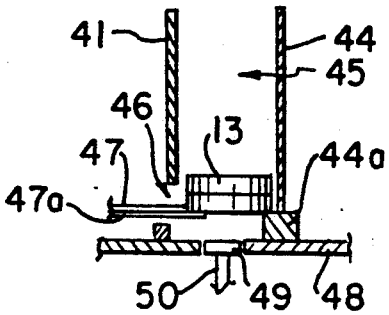

The tape stacking process shall now be described with reference to FIGS. 9–18, each of these figures showing the stacking of a single tape (representative of a layer of four tapes). Therefore, it should be understood that when a single tape is referred to in connection with FIGS. 9–18, actually four tapes comprising a single horizontal layer are being processed. Accordingly, the stacking sequence begins with FIG. 9 wherein tape(s) are slid into the magazine 45 through base openings (not shown) in partition 40 until tapes, two each side of partition 44 have been loaded into the magazine. Shelves 47 and lifters 49 are as shown. In FIG. 10, shelves 47 have been retracted. In FIG. 11 lifters 49 are raised by actuators 50 to push (four) tapes up (approximately one tape thickness) to a level sufficient only to clear shelf extensions **47*a* and the upper surface of partition abutments 44*a*. FIG. 12 shows the shelf extension 47*a* moved under tape(s) 13 to push the opposite side of the tapes onto abutment 44*a* and the lifter 49 being retracted to the position of FIG. 9. FIG. 14 shows the delivery into the magazine of a layer of four tapes beneath the previous layer which is maintained in a raised position by shelves 47 and by abutment 44*a*. FIG. 15 shows retraction of shelves 47. FIG. 16** shows lifting of second layer of tapes to begin to raise the first layer while in FIG. 17 shelf 47 returns to support its side of the second layer and to push the second layer upon abutment 44*a*. In FIG. 18, lifter 49 is retracted. In reviewing the sequence of FIGS. 16–18 it shall be apparent that the next lower layer of tapes, when raised by the lifters 49 also effects lifting of the layer(s) above it until by successive coordinated movements of shelves 47 and lifters 49 the magazine can be filled with a desired number of stacked layers of tapes.

Figure 20:
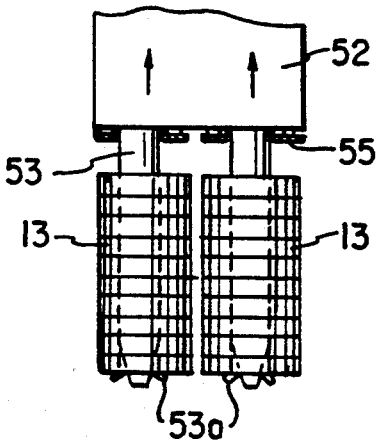
FIGS. 19 to 21 illustrate the removal method and mechanism of the present invention for transferring completely stacked tapes from the magazine into a carton to complete packaging.
Figure 19:
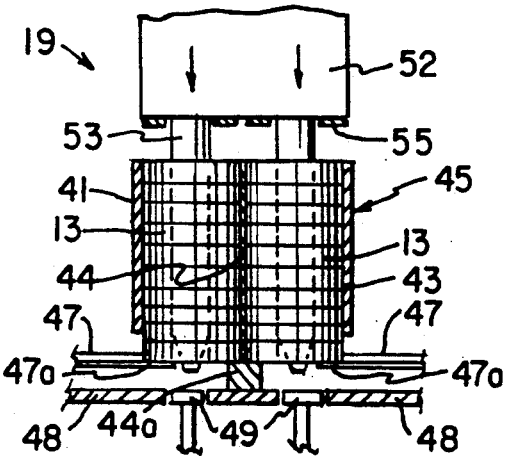
Figure 21:
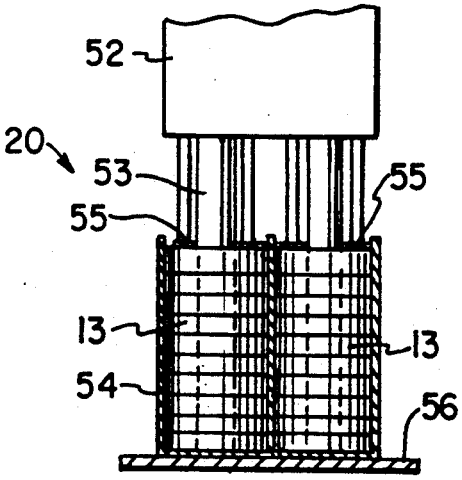

FIGS. 19–21 illustrate the final sequence of packaging the stacked tapes into cartons. In FIG. 19 magazine 45 has been fully loaded with stacked layers of tapes 13. While the bottom layer is supported by shelf extensions 47*a* and abutments 44*a*, a gantry 52 carrying four mandrels 53 shall be moved precisely into position above magazine 45. Mandrels 53 shall be inserted into the aligned central cores of each column of stacked tapes and when fully inserted, tape retention members 53*a* (see FIG. 20) shall be extended beneath the lowermost tapes permitting stacked tapes to be withdrawn from magazine 45. Gantry 52 shall be traversed and lowered (as indicated by arrows) to the position of FIG. 21 wherein the mandrels 52 have deposited the stacked tapes 13 into a carton 54, retention members 53*a* have been retracted and stripping members 55 have begun to separate the stacked tapes from mandrels 53. Cartons 54 are carried in sequence upon conveyer 56 to receive coordinated delivery of stacked tapes from mandrels 53 and for subsequent delivery of filled cartons for shipment.

The above description is of a particular embodiment of the invention directed to packaging tapes. It should be understood that the disclosed stacking method and apparatus may be applied to essentially any product shape, round, rectangular, etc., so long as such product has a flat lower surface and a parallel flat upper surface which permit the described successive lifting, base supporting and stacking techniques to be applied. Accordingly in order to understand fully the scope of the invention, reference should be made to the appended claims.

We claim:

1. A method of packaging tape rolls wherein each tape roll has the same outside diameter and is wound around a central core each of the same diameter, comprising the steps of:

a) conveying successive tape rolls, flat side down into a magazine, b) raising at least one tape roll in the magazine by one tape roll width by pushing vertically upwardly against the down flat side thereof, c) sliding a horizontal support beneath an edge of said tape roll adjacent to the periphery of the magazine and providing a second horizontal support for the opposite side of said tape roll, d) maintaining at least one tape roll in said raised position while inserting there beneath another tape roll in stacked relation thereto, e) repeating the preceding steps until a stack of desired height shall have been formed while surrounding and supporting the stack during the formation of said stack, f) lifting and inserting said stack into a container by inserting a lifting means vertically through respective aligned central cores of the stack, and g) engaging at least the lowermost tape roll in said stack by said lifting means prior to lifting said stack.

2. Apparatus for pre-stacking tape rolls and for packaging said tape rolls after pre-stacking wherein each tape roll has the same outside diameter and is wound around a central core of the same diameter comprising:

a) magazine means having vertical side walls to surround and contain at least one stack of said tape rolls, b) said magazine being open at the top to permit the passage therethrough of said stack, c) means for conveying tape rolls into the bottom of said magazine to form one layer thereof, said magazine including bottom means to support said tape rolls therein, d) means to lift each said layer of tapes vertically from the bottom of said magazine one tape width high into said raised position, e) means forming a fixed horizontal supporting surface within said magazine and a second horizontally movable means forming another horizontal supporting surface, said second horizontally movable means including means to slide said tape upon said fixed horizontal surface, said respective supporting surface means being arranged beneath opposite sides of each said lifted tape to maintain and support said tape while a next said tape is moved by said conveying means there beneath, f) said conveyor means automatically injecting another tape roll into the magazine when the next preceding tape roll has been lifted to said raised position within said magazine, g) said horizontally movable means includes means for laterally moving said raised tape on said first surface and means for intermittent withdrawal from said magazine, and h) the apparatus of (c) (d) (e) (f) and (g) being operated to effect a stack of tapes consisting of a predetermined number of tapes.

3. The apparatus of claim 2 in which prior to pre-stacking, a plurality of said tape rolls are aligned upon a mandrel in spaced apart relation extending through aligned central cores of said tape rolls, means for compressing said tape rolls upon said mandrel to eliminate the spaces between said rolls, and means for transferring said rolls thereafter to said conveying means.

4. The apparatus of claim 3 wherein said transferring means comprises a second mandrel, means for extracting said first mandrel from said tape rolls, means for moving said tape rolls onto said second mandrel and means for moving said second mandrel and to deposit tape rolls therefrom upon said conveying means.

5. A method for vertically stacking in a magazine a plurality of uniformly sized members having generally parallel flat upper and lower sides separated by a generally uniform width; said magazine having a flat bottom and extending therefrom vertical means to contain a stack of said members, said vertical means defining adjacent to the bottom of said magazine a side opening through which said members may be successively slid upon their lower sides into the magazine, the bottom of said magazine defining an opening through which a lifting element may raise successive ones of said members in said magazine to form a stack, said method comprising the steps of:

a) conveying successive members flat side down into said magazine through said side opening therein, b) initially raising each said member from the bottom of said magazine at least one member width thereof, c) providing in said magazine at one side thereof opposite to the opening in the side of the magazine a stationary horizontal support located vertically above the bottom of said magazine at least one thickness of each said member, d) providing a second horizontal support which is reciprocally slidable into and out of said magazine through the side opening in said vertical means; said support having means to engage each said raised member to support and maintain said member in its initially raised position, means to engage each said raised member and to slide said member onto said stationary support, e) conveying a second member into said magazine beneath said first raised member while said first member is supported by said stationary and movable horizontal supports, f) withdrawing said horizontally movable support from said magazine while lifting said second member to support and raise said first member one member width in said magazine, and h) repeating steps (c) through (f) to create a stack of said members in said magazine.

6. Apparatus for vertically stacking in a magazine a plurality of uniformly sized members having generally parallel flat upper and lower sides separated by a generally uniform width comprising:

a) magazine means having vertical sides to surround and contain at least one stack of said members, b) said magazine being open at the top to permit the passage therethrough of said stack, c) means for conveying members into the bottom of said magazine to form one layer thereof, said magazine including bottom means to support said members therein, d) means to lift each said layer of members vertically from the bottom of said magazine one member width high into an initial raised position, e) means forming a fixed horizontal supporting surface within said magazine and a second horizontally movable means forming another horizontal supporting surface, said second horizontally movable means including means to slide said member upon said fixed horizontal surface, said respective supporting surface means being arranged beneath opposite sides of each said lifted member to maintain and support said member while a next said member is moved by said conveying means there beneath, f) said conveyor means automatically injecting another member into the magazine when the next preceding member has been lifted to said raised position within said magazine, g) said horizontally movable means includes means for laterally moving said raised member on said first surface and means for intermittent withdrawal of said horizontally movable means from said magazine, and h) the apparatus of (c) (d) (e) (f) and (g) being operated to effect a stack of members consisting of a predetermined number of members.

* * * * *